United States Patent [19]

Avidan et al.

[11] Patent Number: 4,986,896

[45] Date of Patent: Jan. 22, 1991

[54] METHOD FOR PASSIVATING METALS ON AN FCC CATALYST

[75] Inventors: Amos A. Avidan, Yardley, Pa.; Arthur A. Chin, Cherry Hill, N.J.

[73] Assignee: Mobil Oil Corp., Fairfax, Va.

[21] Appl. No.: 337,685

[22] Filed: Apr. 13, 1989

[51] Int. Cl.[5] ..... C10G 11/00; B01J 38/04

[52] U.S. Cl. ..... 208/52 CT; 208/113; 502/521; 502/34

[58] Field of Search ..... 208/52 CT, 113; 502/521, 34

[56] References Cited

U.S. PATENT DOCUMENTS

| | | | |
|---|---|---|---|
| 2,219,693 | 8/1935 | Houdry | 208/119 |
| 4,263,130 | 4/1981 | Bertus et al. | 208/52 CT |
| 4,268,416 | 5/1981 | Stine et al. | 208/52 CT |
| 4,280,895 | 7/1981 | Stuntz et al. | 208/113 |
| 4,404,089 | 9/1983 | Zrinscak | 208/120 |
| 4,409,093 | 10/1983 | Bearden, Jr. et al. | 208/108 |
| 4,432,864 | 2/1984 | Myers et al. | 208/120 |
| 4,504,379 | 3/1985 | Stuntz et al. | 208/113 |
| 4,504,380 | 3/1985 | Stuntz et al. | 208/113 |
| 4,522,704 | 6/1985 | Bertsch | 208/113 |
| 4,541,923 | 9/1985 | Lomas et al. | 208/113 |
| 4,666,584 | 5/1987 | Luckenbach et al. | 208/113 |

FOREIGN PATENT DOCUMENTS

| | | | |
|---|---|---|---|
| 729167 | 3/1966 | Canada | 502/521 |

OTHER PUBLICATIONS

*Oil and Gas Journal*, Technology, Habib, Jr., "Sox Transfer Catalyst System for FCC Need Development," pp. 111–113, Aug. 8, 1983.

*Primary Examiner*—Chung K. Pak

*Attorney, Agent, or Firm*—Alexander J. McKillop; Charles J. Speciale; Dennis P. Santini

[57] ABSTRACT

A known method for passivating contaminant metals on an FCC catalyst comprises treating the catalyst with a sufficient amount of a sulfur-containing compound capable of associating with the contaminant metals when in contact therewith. An improvement comprises contacting the catalyst with the sulfur-containing compound for at least 3 seconds. In another embodiment of the invention, the improvement comprises contacting the catalyst with the sulfur-containing compound in a separate treatment vessel.

9 Claims, 1 Drawing Sheet

METHOD FOR PASSIVATING METALS ON AN FCC CATALYST

The present invention relates to an improved process for passivating metals on a hydrocarbon cracking catalyst in an FCC process. More particularly, the invention relates to a more efficient way of contacting a regenerated cracking catalyst with certain passivating gases.

BACKGROUND OF THE INVENTION

It is often desirable to convert raw hydrocarbon mixtures such as crude oil and other petroleum feedstocks to commercially valuable fuels. A number of processes for cracking hydrocarbons are known. These processes include fluid catalytic cracking (FCC) (including the FCC process of Ashland/UOP known as reduced crude conversion (RCC)). These processes are described in Venuto and Habib, "Fluid Catalytic Cracking with Zeolite Catalysts", Marcel Dekker, Inc., 1979 and Busch et al., "Reduced Crude Conversion—1: RCC Complex Now Cornerstone of Ashland Refinery", Oil & Gas Journal Dec. 10, 1984.

The cracking of hydrocarbons is accomplished by contacting the hydrocarbon to be cracked with a catalyst at elevated temperatures. The catalysts most commonly used for cracking hydrocarbons comprise a crystalline aluminosilicate zeolite that has been incorporated into a matrix. These zeolites are well known and have been described, for example, in U.S Pat. Nos. 4,432,890, 4,707,461 and 4,465,779.

The matrix into which the zeolite is incorporated may be natural or synthetic and, typically, has substantially less and in some cases no catalytic activity relative to the zeolite component. Some known matrices include clays, silica, metal oxides such as alumina and mixtures thereof.

A major difficulty with cracking catalysts is their tendency to become poisoned following contact with certain metal contaminants present in the hydrocarbon feedstock. The deleterious metals include vanadium, nickel, iron and copper. These metals may be present in the hydrocarbon as free metals or as components of inorganic and organic compounds such as porphyrins and asphaltenes. Poisoning leads to loss of selectivity, which causes increased amounts of undesirable products such as coke and light gases, i.e., hydrogen, methane and ethane. The deleterious effect of metals on cracking catalysts has been discussed, for example, in U.S. Pat. Nos. 4,376,696, 4,513,093, and 4,515,900.

Methods for counteracting the deleterious effects of metals have been developed. For example, it is known to treat FCC catalysts containing such metal contaminants with certain passivating gases. The passivating gases may, for example, be reducing gases or sulfur-containing gases.

Reducing gases used for passivating metals on an FCC cracking catalyst include hydrogen, carbon monoxide, and hydrocarbons. Sources of these reducing gases include, for example, hydrogen streams, cat cracker tail-gas, catalytic reformer tail-gas, spent hydrogen streams from catalytic hydroprocessing, synthesis gas, steam cracker gas, flue gas and mixtures thereof.

The efficiency of contacting the catalyst and the reducing gas has been recognized as being important. For example, the residence time required for passivation is discussed in U.S. Pat. No. 4,666,584 (see column 6, line 25 et seq.) and U.S. Pat. No. 4,522,704 (see column 6, line 32 et sec.). Separate passivation zones for contacting cracking catalysts and reducing gases are disclosed in U.S. Pat. Nos. 4,504,379 4,504,380, 4,409,093, 4280,895 and 4,522,704.

Less is known about the conditions for passivating gases with sulfur-containing compounds. U.S. Pat. No. 4,541,923 discloses that hydrogen sulfide may accompany the lift gas in an FCC process (see column 6, line 7, et sec.). Recycled water containing hydrogen sulfide is disclosed as being useful for passivating metals during hydrocarbon cracking at column 5, line 65, et seq. of U.S. Pat. No. 4,432,864.

Nevertheless, not enough is known about how to maximize the passivation of metals in an FCC process using sulfur-containing gases. For example, the effects of residence time and the point of contact between the catalyst and the gas have been insufficiently explored In fact U.S. Pat. No. 4,404,089 discloses that the point of contact is not critical (see column 3, line 57 et seq). There is a need, therefore, for improved methods for passivating metals on an FCC catalyst with sulfur-containing compounds. In particular, there is a need for improvements that maximize the efficiency of such methods.

OBJECTS OF THE INVENTION

It is, therefore, an object of the present invention to provide an improved method for passivating metals on an FCC catalyst by contacting the catalyst with a sulfur-containing compound.

More particularly, it is an object of the present invention to provide a method for passivating metals on an FCC catalyst by contacting the catalyst with a sulfur-containing compound for an amount of time that improves passivation.

It is a further object of the present invention to provide a method for passivating metals on an FCC catalyst by contacting the catalyst with a sulfur-containing gas in a separate specially designed passivation vessel.

SUMMARY OF THE INVENTION

These and other objectives of the present invention as will be apparent from the following disclosure have been met by providing an improvement in a method for passivating contaminant metals on an FCC catalyst. The method comprises treating the catalyst with a sufficient amount of a sulfur-containing compound capable of associating with the contaminant metals when in contact therewith. The improvement comprises contacting the catalyst with the sulfur-containing compound for at least 3 seconds. In another embodiment of the invention, the improvement comprises contacting the catalyst with the sulfur-containing compound in a separate treatment vessel.

DETAILED DESCRIPTION OF THE INVENTION

Figure 1:
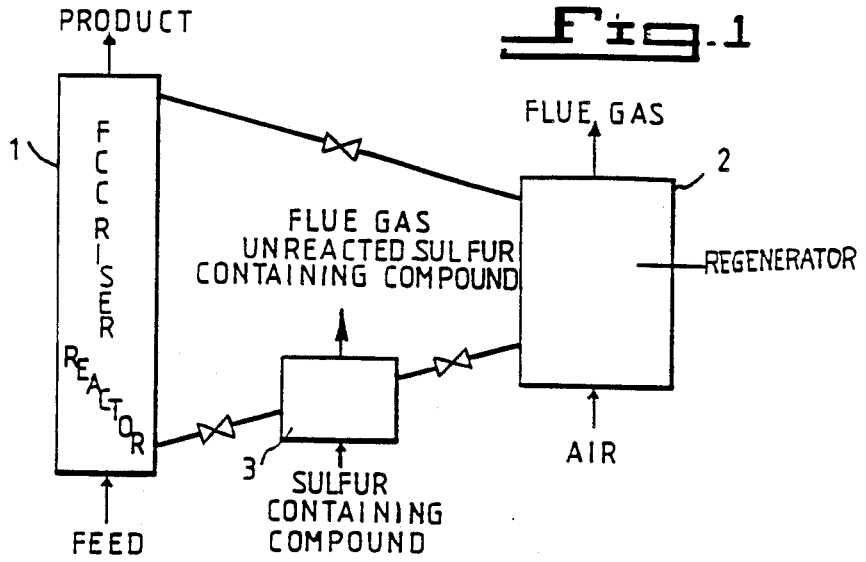
FIG. 1 is a schematic drawing of a treatment vessel integrated into a typical FCC unit.

Referring now to FIG. 1, the cracking of hydrocarbons in an FCC process occurs in the FCC riser reactor (1), where the FCC feedstock contacts the FCC catalyst. The catalyst is in the form of particles, such as microspheres, that are suspended in oil, vapor or gas.

The feedstock contacts the catalyst, and is cracked to lighter products. During the operation, the catalyst is deactivated by the deposition of coke and deleterious metals on its surface. The hydrocarbon stream is separated from the catalyst and passes to a fractionation zone, which, in an FCC process, is often referred to as the main column. In the fractionation zone, the hydrocarbon is separated into desired fractions such as light gases, gasoline, light cycle oil, heavy cycle oil, and slurry oil.

The hydrocarbon feedstock that can benefit from the present invention includes any feedstock containing metal contaminants that adversely affect the product selectivity of cracking catalysts. The feedstock may, for example, be a whole crude oil, a light fraction of crude oil, a heavy fraction of crude oil, or other fractions containing heavy residua, such as co-derived oils, shale oils, and the like.

The deleterious metals that contaminate the catalyst include vanadium, nickel, iron and copper.

Any FCC cracking catalyst that is adversely affected by metal contaminants will benefit from being subjected to the process of the invention. Some natural zeolites typically used in the cracking process include faujasite, mordenite and erionite. The natural zeolites may be treated so as to produce synthetic zeolites such as, for example, Zeolites X, Y, A, L, ZK-4,B, E, F, H, J, M, Q, T, W, Z, alpha, beta, ZSM-5 and omega. Additional cracking catalysts are described, for example, in Venuto and Habib, "Fluid Catalytic Cracking with Zeolite Catalysts", Marcel Dekkar, Inc., Page 30 (1979); Rabo, J. A. ed., "Zeolite Chemistry and Catalysis", ACS Monograph 171, 1976; and Szostak, R., "Molecular Sieves—Principles of Synthesis and Identification", Van Nostrand Reinhold, 1989.

The spent catalyst that is separated from the cracked feedstock passes to the regenerator (2). In the regenerator, the spent catalyst is treated with an oxygen-containing gas at about 622° C. to about 816° C. in order to combust adsorbed coke. The combustion of coke produces a regenerated catalyst along with flue gas, which contains carbon monoxide, carbon dioxide, water, nitrogen and oxygen. The oxygen-containing gas in the regenerator is usually air.

In the method of the present invention, the regenerated catalyst comes into contact with a sulfur-containing compound in the gas phase. It has unexpectedly been found that the efficiency of passivating the metal contaminants is significantly increased when the contact time is three seconds or more. Preferably, the contact occurs for at least 4 seconds, and more preferably, 5–10 seconds. The catalyst and the sulfur-containing compound are contacted at a temperature between 482° and 982° C., preferably between 593° and 760° C., and more preferably between 649° and 732° C. The amount of the sulfur-containing compound that contacts the catalyst is sufficient to effectively passivate the active metals present on the catalyst. For example, a molar ratio of S:Ni equivalents (Ni+0.25V) between 0.05:1 and 5:1 is advantageous.

The sulfur-containing compound will typically be hydrogen sulfide. Other sulfur-containing compounds, usually organic sulfur-containing compounds, may also be used. It is believed that the organic compounds decompose under the passivation conditions to hydrogen sulfide. Some examples of organic sulfur-containing compounds include lower alkyl thiols, thioethers, and disulfides. Typical examples of such compounds include thiomethane, thioethane, thiobutane, dimethylsulfide, diethylsulfide, and di-tertiary nonyl polysulfide. Inorganic sulfur compounds such as carbon disulfide are also effective.

The mechanism of passivation is unknown, and the invention is not limited to any particular mechanism. It is believed that the metal associates chemically with one or more sulfur atoms. The association may, for example, be in the form of a metal-sulfur or metal oxide bond. The metal may, for example, be converted to a metal sulfide or oxysulfide.

The source of the sulfur-containing compound may also be from another oil refining operation. For example, the source of hydrogen sulfide may be a sour fuel gas or a slip stream from the feed to a Claus unit. The source of disulfides may be a Merox extraction unit.

In the process of the present invention, the sulfur-containing compound is added in a way that increases the contact time between the catalyst and the sulfur-containing compound prior to contacting oil. For example, the sulfur-containing gas may be added to the transfer line between the regenerator and the riser of a typical FCC unit. Generally, the interaction of the catalyst and the sulfur-containing compound will be inadequate if the sulfur-containing compound is added to the bottom of the riser, where contact times are generally limited to less than two seconds.

As an example of the beneficial results obtained in accordance with the present invention, experiments in a continuous circulating FCC pilot unit showed reductions of 12 to 18% in coke selectivity and 20–25% in hydrogen yield when an equilibrium catalyst containing 3500 ppm nickel equivalents was pretreated with 0.5 weight percent $H_2S$ on feed. The $H_2S$ was added to the transfer line between the reactor and regenerator to give a treatment time of 3 seconds. Analysis of the catalyst showed that approximately 20 to 40% of the $H_2S$ added was adsorbed. Larger benefits are obtained with higher rates of $H_2S$ addition. For example the production of coke and hydrogen was reduced by over 30% with 0.8% by weight $H_2S$. When the $H_2S$ was added in a manner to give less than 2 seconds catalyst contact time, however, the treatment was ineffective.

Preferably the metals on the catalyst are passivated by contacting the catalyst with a sulfur-containing compound in a separate treatment vessel(3). The separate vessel has the advantage of providing longer, more controllable contact times and more intimate contact. A separate vessel also eliminates the possibility of transfer line bubbles that are rich in the sulfur-containing compound. Such bubbles tend to limit the catalyst circulation rate and may cause corrosion. The use of a substantially vertical vessel is particularly advantageous over a sloped catalyst transfer line, since there is less flow segregation with a vertical vessel.

An additional advantage of a separate treatment vessel for contacting the catalyst with the sulfur-containing compound is the prevention of unreacted hydrogen sulfide from entering the riser (1). Besides requiring additional downstream gas handling capabilities, the presence of unreacted $H_2S$ or other sulfur-containing compound in the riser may affect liquid product quality by increasing its sulfur content. Instead of being returned to the riser, the sulfur-containing compound may, in the present invention, be recirculated to the treatment zone, reducing the requirements for additional sulfur-containing compound.

Preferably, the vessel has a diameter that is at least 10% larger than the diameter of the transfer line. More preferably, the diameter of the vessel is at least 20% larger than the diameter of the transfer line.

The treatment vessel is preferably located between the regenerator and the feed injection point to the riser. The regenerator may be operated under net oxidizing conditions (complete coke burning) or net reducing conditions (partial coke burning). The treatment vessel need not be maintained in a reducing hydrocarbon atmosphere.

Figure 2:
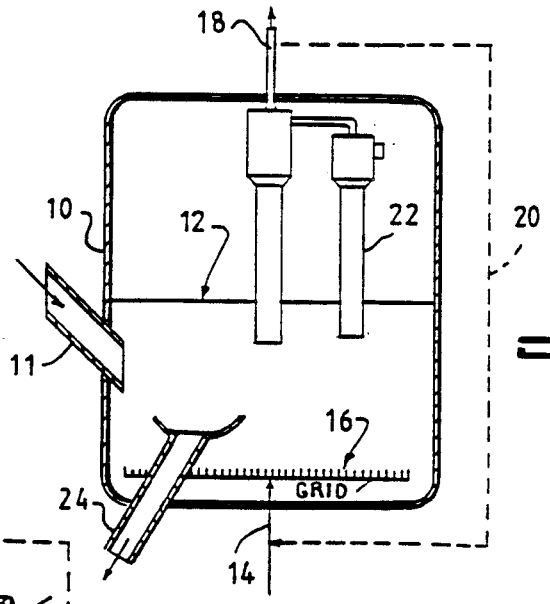
FIGS. 2 and 3 illustrate possible designs for the treatment vessel.

The size, shape and design of the separate treatment vessel (3) should be suitable for contacting an FCC catalyst with a sulfur-containing gas at elevated temperatures. FIG. 2 shows a treatment vessel design that enables good mixing and high contact times. The catalyst enters the treatment vessel tangentially to the vessel walls (10) through the regenerated catalyst transfer line (11) below the level (12) of catalyst already in the vessel. The sulfur-containing compound enters the vessel through line (14), and is dispersed through grid 16. Effluent gases, which include unreacted sulfur-containing compound and flue gas, exit through line 18. Some of the effluent gas may be recycled back to the catalyst in the treatment vessel through line 20 or 22. The tangential introduction of the catalyst through line 11 causes the catalyst in the treatment vessel to swirl. The swirling catalyst contacts the hydrogen sulfide distributed through grid 16, causing the catalyst to be passivated. The passivated catalyst exits through line 24, which leads to the riser.

Figure 3:
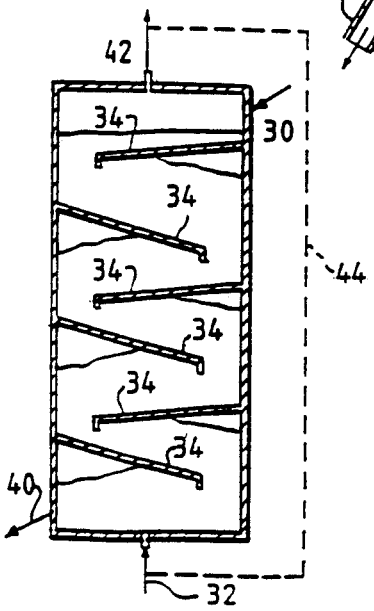

Another possible vessel design is similar to a spent catalyst stripper as is known in the art. Such a design is shown in FIG. 3. A regenerated catalyst enters the treatment vessel through line 30, where it contacts the sulfur-containing gas, which enters through line 32. Good contact is promoted by a series of internal baffles, 34. The passivated catalyst exits through line 40, which leads to the riser. The unreacted sulfur-containing gas and other residual gases, such as flue gas, exit effluent line 42 and may be recycled back to the treatment vessel through line 44.

Some space should be allowed in the treatment vessel above the level of the catalyst for the settling of fines. Fines may be effectively removed by methods known in the art, such as the use of a cyclone or a sintered metal filter. Preferably, the FCC catalyst contains at least 20% fines in the treatment vessel in order to control bubble size and improve contact efficiency. Fines are particles that are 40 microns or less in diameter for the purpose of this specification.

What is claimed is:

1. In a method for passivating contaminating metals on a crystalline aluminosilicate zeolite FCC catalyst comprising treating the catalyst with a sufficient amount of a sulfur-containing compound capable of associating with the contaminating metals when in contact therewith, the improvement comprising contacting the catalyst with the sulfur-containing compound for at least three seconds, said contacting occurring in a separate treatment vessel, containing internal baffles ventilating unreacted sulfur-containing compound away from entry into a riser/reactor and recycling a portion of unreacted sulfur-containing compound back to the treating vessel, wherein the FCC catalyst contains fines in the treating vessel.

2. The method according to claim 1 wherein the sulfur-containing compound is hydrogen sulfide, carbon disulfide, or an organic sulfide.

3. The method according to claim 1 wherein the sulfur-containing compound is hydrogen sulfide.

4. The method according to claim 1 wherein the molar ratio of sulfur in the sulfur-containing compound to Ni equivalents is between 0.05:1 and 5:1.

5. The method according to claim 1 wherein the treatment vessel is located between the regenerator and the point where the regenerated catalyst contacts feedstock in the cracking zone.

6. The method according to claim 1 wherein the treatment vessel has a diameter that is at least 10% larger than the diameter of the transfer line.

7. The method according to claim 1 where the vessel is substantially vertical.

8. The method according to claim 1 wherein a sintered metal filter or a cyclone is used to effectively remove fines from the effluent gas.

9. The method according to claim 1 wherein the FCC catalyst contains at least 20% fines in the treating vessel.

* * * * *